United States Patent [19]

Quigley

[11] 4,446,659

[45] May 8, 1984

[54] AUTOMATIC SEATING FOR TELESCOPING ROW SYSTEMS

[75] Inventor: Robert E. Quigley, Seymour, Ill.

[73] Assignee: American Seating Company, Grand Rapids, Mich.

[21] Appl. No.: 451,348

[22] Filed: Dec. 20, 1982

[51] Int. Cl.[3] ..... E04H 3/12

[52] U.S. Cl. ..... 52/9; 297/331

[58] Field of Search ..... 52/8-10; 297/236, 331, 332

[56] References Cited

U.S. PATENT DOCUMENTS

| | | | |
|---|---|---|---|
| 3,279,131 | 10/1966 | Curra | 52/9 X |
| 3,352,069 | 11/1967 | Curra | 52/9 |
| 3,869,835 | 3/1975 | Mackintosh | 52/9 |
| 4,000,586 | 1/1977 | Vance et al. | 52/9 |
| 4,063,392 | 12/1977 | Van Ryn et al. | 52/9 |
| 4,155,202 | 5/1979 | Hartman | 52/9 |
| 4,189,876 | 2/1980 | Crossman et al. | 52/9 |
| 4,294,048 | 10/1981 | Sutter | 52/9 |

FOREIGN PATENT DOCUMENTS

| | | | |
|---|---|---|---|
| 2735911 | 2/1979 | Fed. Rep. of Germany | 52/9 |
| 2384920 | 11/1978 | France | 52/9 |
| 1420615 | 1/1976 | United Kingdom | 52/9 |

*Primary Examiner*—J. Karl Bell

*Attorney, Agent, or Firm*—Emrich, Lee, Brown & Hill

[57] ABSTRACT

A telescoping seating system has a plurality of rows adapted for movement between an extended or use position and a retracted or storage position. Each row is equipped with seating mounted on a frame which, in turn, is mounted to the rear of the deck of a row for pivoting between a raised or use position and a lowered or storage position, where the seating is positioned between the decks of adjacent rows when stored. A latch mechanism for locking the seating frame in the raised position when a row is extended includes a drive rod extending above and along a rear portion of the deck. The drive rod is spring-biased to rotate in one direction toward a locking position in which latch members carried by it engage the seating frame to lock it in place when the frame is raised. Arms connected to the drive rod extend below the deck of the row on which the seating frame is mounted and are engaged and counter-rotated to a release position when the next lower row is substantially retracted to a position almost fully nested beneath the aforementioned higher row. If any one arm is engaged and actuated, the drive rod is counter-rotated to release all of the seating for that row. Thus, the seating of a row is unlocked by the retraction motion of the next lower row and uniform seat unlocking is accomplished before the row on which the seating is mounted begins to retract.

23 Claims, 7 Drawing Figures

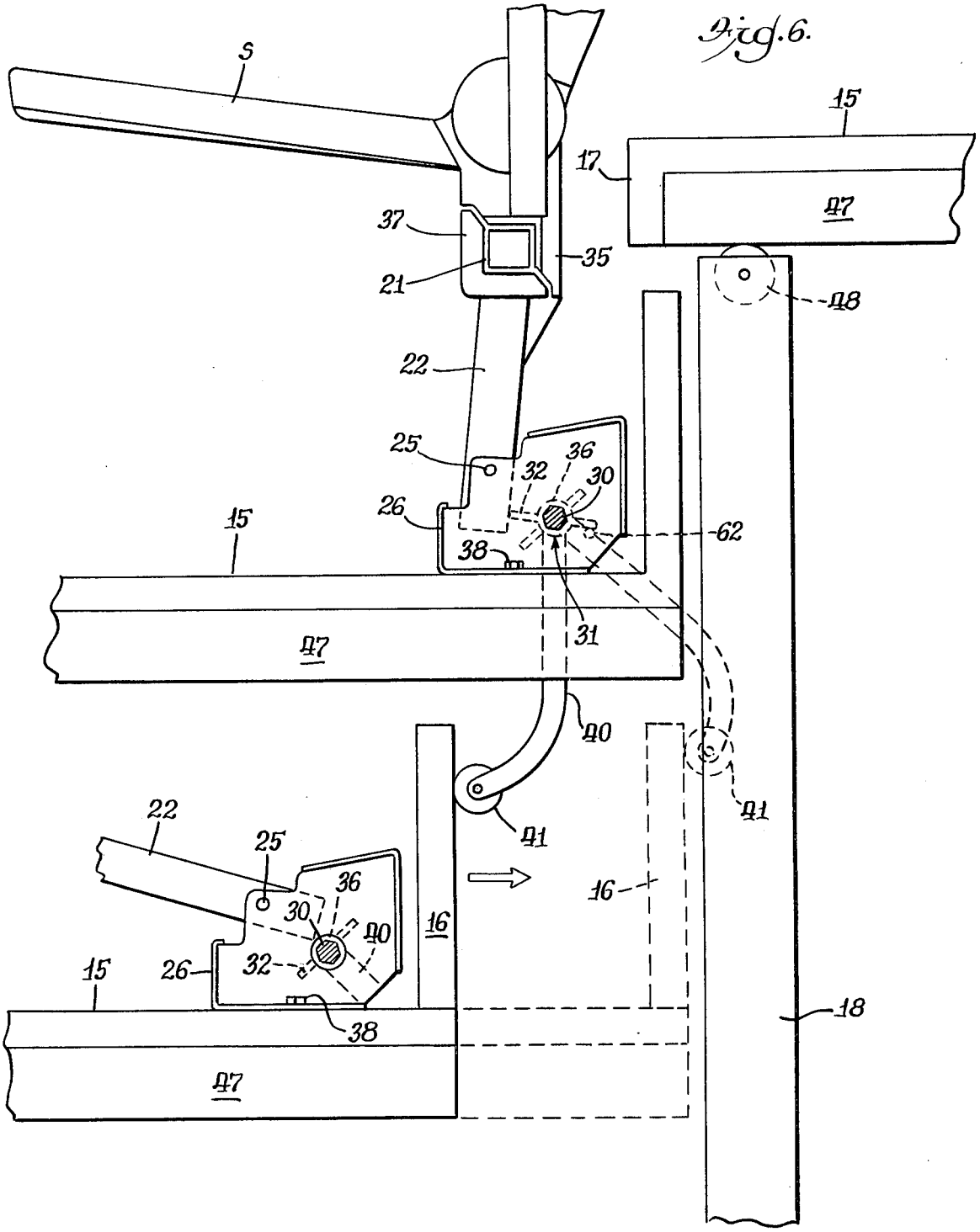
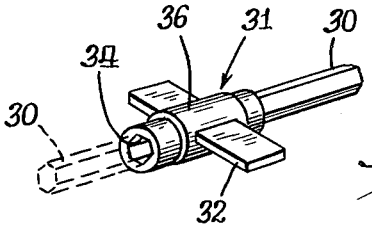
Fig.7.

AUTOMATIC SEATING FOR TELESCOPING ROW SYSTEMS

BACKGROUND AND SUMMARY OF THE INVENTION

The present invention relates to telescoping seating systems; and more particularly, it relates to improvements in telescoping seating systems wherein the seating is automatically raised to the use position when the rows are extended, and automatically lowered for storage between adjacent decks when the rows are retracted for storage.

Telescoping seating systems are well-known in the art, and generally include a plurality of rows, each row having wheeled carriages for movement along the floor of a gymnasium or auditorium, a frame or understructure including columns or posts extending vertically from the carriages to the height of a given row, and a deck mounted to the top of the understructure. The deck normally includes a riser beam secured to the top of the posts in the understructure and outwardly extending arms for mounting the platform or deck material.

Power systems are frequently used to move the telescoping rows between the use and storage positions, thereby affording a great convenience in converting the seating to different uses. One such power system is disclosed in my U.S. Pat. No. 4,285,172. Despite the convenience and labor savings provided by such power systems, a substantial amount of labor may nevertheless still be required to raise the seating from its storage position to the use position. This is particularly so, for example, in chair platform systems which provide individual chairs, as distinguished from bleacher type seating which may be fixed.

Individual chair type seating is preferred over bleacher type seating in terms of convenience and comfort for the individual occupant, but the need for manual labor to set up the chairs after the system is extended has been considered a disadvantage, particularly in large installations because it requires either a large number of laborers to raise the seating before use and to lower it after use, or a smaller number of laborers but a much longer time to effect conversion of the seating.

There have been attempts to provide individual chair-type seating which is raised and lowered automatically with the extension and retraction of the rows, one such system being disclosed in the co-owned Van Ryn, et al U.S. Pat. No. 4,063,392. Another automatic chair platform system and one which was available commercially is that disclosed in the co-owned Hartman U.S. Pat. No. 4,155,202. The system disclosed in the Van Ryn, et al patent includes chairs mounted to the forward portion of a deck wherein only the back of an individual chair is locked in the raised position, and although all of the chair backs on a given row are locked and unlocked in response to the actuation of a single tube, the tube is mounted beneath the deck and separate latching and unlatching mechanisms are required for the back of each individual chair. Thus, the system is somewhat complicated and expensive, and is not considered to be sufficiently reliable for commercial introduction. Further, the height of the seat above the platform varies with the rise of the system; amd a given row is moved toward the storage position (beneath the next higher row) before the seat backs on that row are unlocked.

The system disclosed in the Hartman U.S. Pat. No. 4,155,202 overcomes the problem of changing the height of the seat above the platform as the rise of the system varies by mounting individual chairs to a frame and attaching the bottom of the frame to the rear of the platform. However, each gang of chairs is locked in place by at least two locking members, the tops of which are engaged by the nose portion of the next higher row when a given row is retracted. Typically, such systems are offered with a variation in rise ranging from 10"-16". Because the seating frame slants rearwardly toward the nose of the next higher row, as the rise of a system increases, the distance between the nose and seating frame decreases, and the inherent tolerances in the system would, under certain conditions, permit one locking member to be released, but the other to remain locked, thereby permitting the nose of the next higher row to bind against the seating frame. This is particularly true if for any reason two adjacent rows are not parallel to one another, with the problem aggravated, as mentioned, in systems having a greater rise.

Thus, a principal object of the present invention is to provide automatic seating in a telescopic system which tolerates a certain amount of "out of parallel" motion of adjacent rows.

According to the present invention, each row is equipped with chair-type seating, preferably with a plurality of chairs mounted on a common frame. The frame is attached to the rear of a deck of a row for pivoting between a raised or use position and lowered or storage position in which the seating is stored in the space between the decks of adjacent rows.

A latch mechanism for locking the seating frame in the raised position when a row is extended for use includes a drive rod, preferably having an hexagonal cross-section, extending along the rear of the deck, and mounted above the platform or deck material.

The drive rod is mounted for rotation in one direction in which latch members carried by the drive rod are positioned to engage the seating frame and lock it in the raised or use position. If the drive rod is rotated in a counter direction, the seating is unlocked and prepared to be lowered for storage. The weight of the seating may be counter-balanced by torsion rods or other counter balancing mechanism, as disclosed in the Hartman patent identified above.

The drive rod is located at the rear of a deck and is mounted above the footrest or sheet material. The rod is provided with two or more actuator arms which extend below the deck and are engaged and actuated by the retracting motion of the next lower row. Thus, the seating on a given row is unlocked before that row begins its retraction cycle. Preferably, the actuator arms are not engaged until the next lower deck has substantially completed its retraction motion, and this results in an upper row lock system, forcing the rows to retract in the desired sequence of having the lowest extended row retract before all others, as more fully described presently. It is considered to be another feature of this invention that if any one actuator arm is actuated by the rearward motion of the next lower deck, then the drive rod is rotated in its counter direction and all of the seating on that row is unlocked simultaneously. This is in contrast to the mechanism disclosed in the Hartman patent wherein all of the independent latches must be disengaged before the seating can be lowered, with the disengaging action effected by the retraction motion, not of the next lower row, but of the very row on which the seating to be lowered is mounted. In contrast, the present invention is characterized in that the seating of one row is unlocked by the retraction motion of the next lower row, with unlocking accomplished by actuating any one of a number of actuators before that particular row has even begun its retraction motion. This forces the rows to close or retract in such a manner that the lower row retracts first. The present invention thus provides a system of row locks, as mentioned, locking the upper rows in an extended position until the next lower row retracts. The rows are thus retracted in the desired sequence with all the seats in a given row (or group) unlocked simultaneously and responsive to the next lower row's being displaced rearwardly during a retraction cycle.

The drive rod is spring-biased to rotate in the locking direction which actuates the latch mechanism to engage the seat frame when a row is extended to lock the seating in a positive manner, as distinguished from relying on gravity, for example. Thus, counter-rotation of the drive rod by retraction of the next lower row works against the bias of the spring, but spring biasing the drive rod toward the locking position is considered advantageous in effecting a positive latching function.

Other features and advantages of the present invention will be apparent from the following drawings wherein identical reference numerals will be used to refer to like parts of the various views.

THE DRAWINGS

FIG. 6 is a fragmentary close up right side view of the system of FIG. 1 showing adjacent rows in the storage and use positions, and illustrating operation of the latch mechanism; and FIG. 7 is a perspective view of the actuating rod and latching mechanism for engaging a chair frame and locking a linear chair arrangement in the raised or use position.

DESCRIPTION OF THE PREFERRED EMBODIMENT

Figure 1:
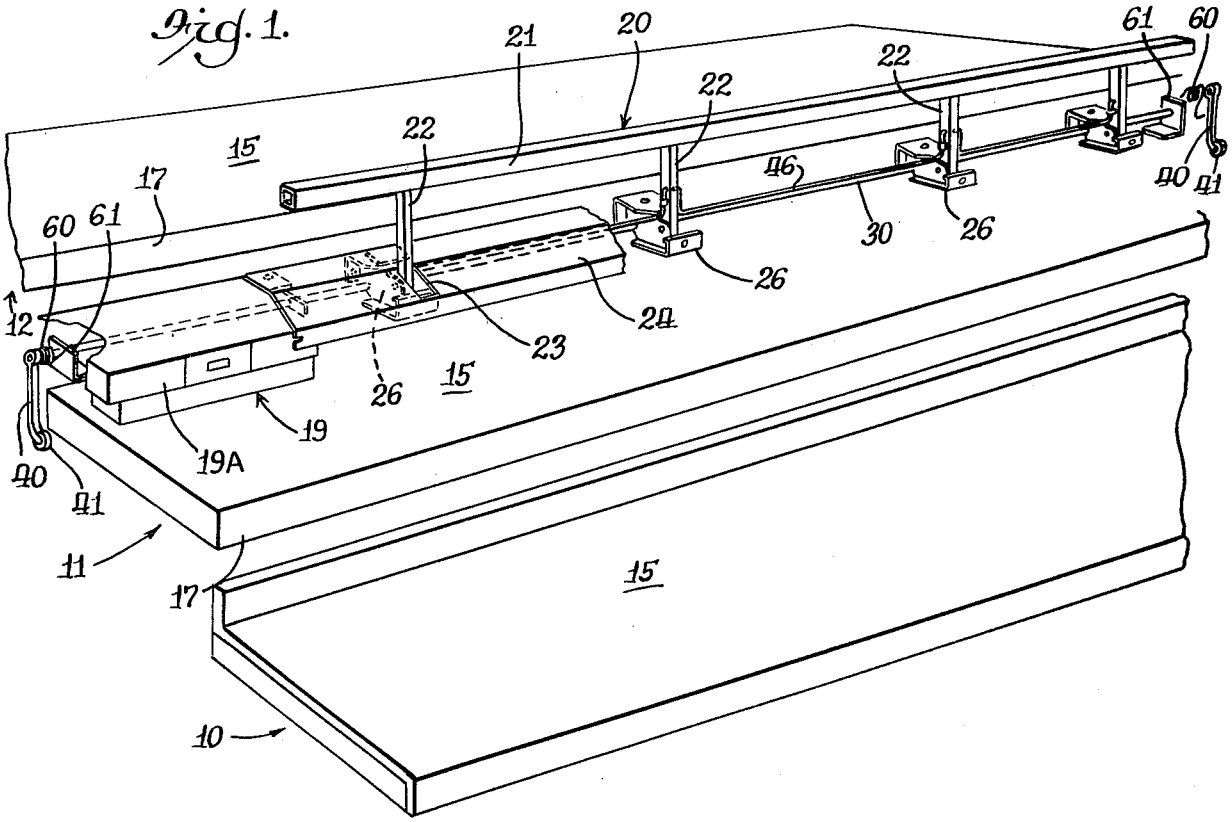
FIG. 1 is an upper front perspective view showing a portion of a telescopic seating system incorporating the present invention.

As used herein, "left" and "right" refer respectively to the left and right sides of an observer standing in front of the seating system (i.e., toward the right in FIG. 2) and facing the system. Referring to FIG. 1, portions of three rows of a telescoping seating system having a plurality of rows are shown. These rows are generally designated 10, 11 and 12 respectively. When the system is extended to the use position (see roW 11 relative to row 12), the rows are in stepped or tiered relation. When the system is retracted for storage, the rows are generally vertically aligned with a lower row nested beneath a higher row.

In the present invention as shown in FIG. 1, a seating frame 20 (or "mounting beam" as it is sometimes called) is pivotally mounted by means of a stanchion bracket 26 to the deck portion 15 of a row. The seating frame 20 supports a linear arrangement of foldable seats which are not shown in the figure in order to more clearly show the essential elements of the invention. The linear arrangement of foldable seats extends substantially the entire length of each row, with an aisle space 19 provided at the end of a seating row arrangement to facilitate spectator ingress and egress.

Seating frame 20 includes a plurality of stanchions 22 which are generally vertically oriented when the seats are in the use or upright position. Each stanchion 22 is rigidly coupled at one end to a mounting beam 21 and pivotally coupled at the other end thereof to a stanchion bracket 26 which, in turn, is securely coupled to the deck 15 of a row. As explained more fully below, seating frame 20 is rotated clockwise (as viewed from the left in FIG. 2) to rest on the deck of row 11 for storage between adjacent rows 11, 12 when the telescoping seating system of FIG. 1 is retracted.

The seating frame 20 may extend the entire length of the row upon which it is mounted, while leaving space for aisles, or two or more frames may be mounted adjacent one another. Each aisle is defined by and provided with a plurality of step elements 19A arranged in a generally linear array and positioned on adjacent rows. Step elements 19A not only facilitate movement up and down the telescoping seating system, but also provide a protective cover for components of the latching system as shown in the drawing.

The seating arrangement of FIG. 1 includes a plurality of safety covers one of which is seen at 24. The stanchions 22 extend in the spaces designated 23 between adjacent covers. Spaces 23 between the covers 24 permit the free movement of the stanchions 22 which are pivotally mounted to respective mounting brackets 26.

Figure 2:
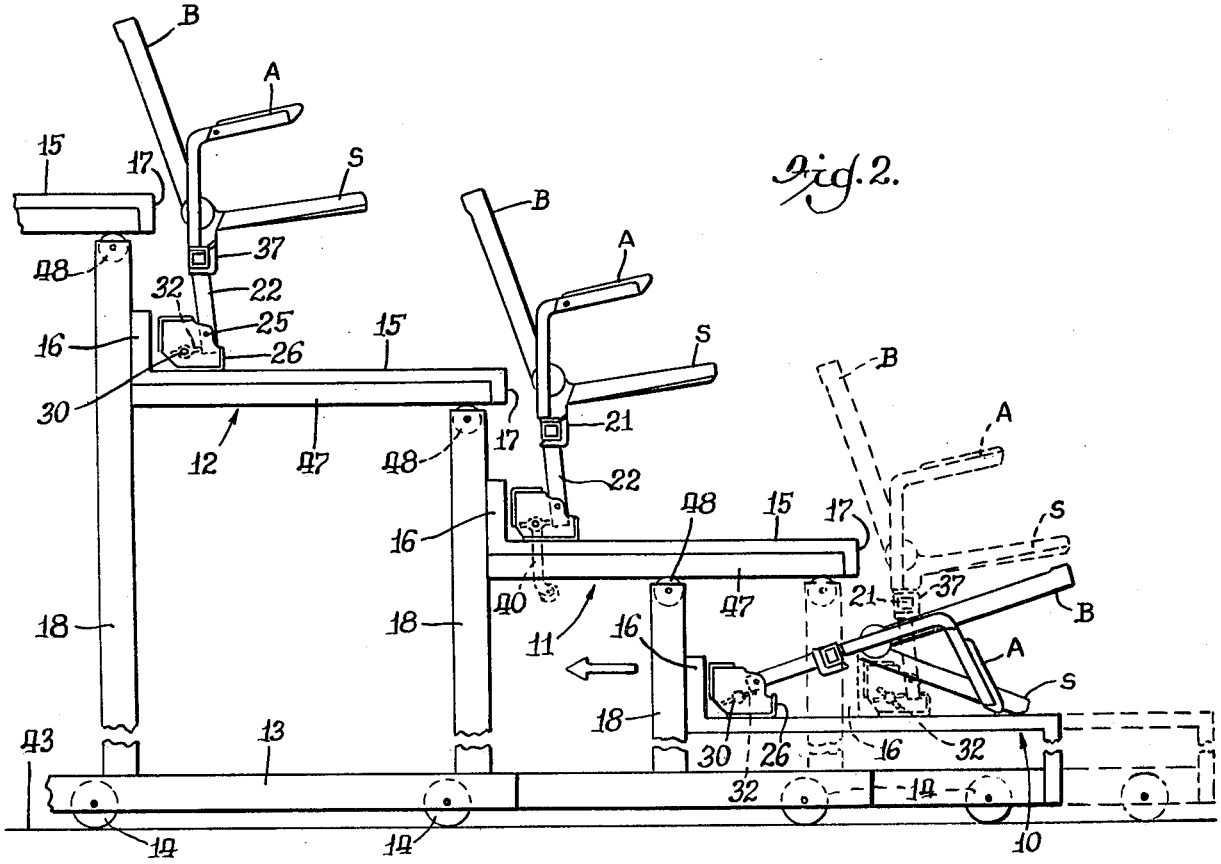
FIG. 2 is a fragmentary left side view of a more complete telescoping seating system incorporating individual chair type seating and illustrating the opening and closing sequence.

A torsion rod 46 is secured to each stanchion 22, and extends laterally thereof and is fixed to the mounting bracket 26 associated with the next adjacent stanchion. The detailed structure of the torsion rod 46 and mounting bracket 26 combination is described below. However, it will be understood that the torsion rod 46 acts as an energy storing means such that when the chair is lowered, the torsion rod 46 is twisted clockwise (when viewed from the left), as illustrated in the sequence of positions as shown in FIG. 2. Thus, in the storage position, the torsion rod 46 acts to at least partially offset the weight of the seating frame 20 and foldable seats supported thereon.

Rotationally positioned within each of the mounting brackets 26 and extending substantially the entire length of a row is a drive rod 30 having a latch member or "butterfly" for each stanchion and an actuating arm 40 fixedly positioned on each end thereof. The ends of the drive rod are rotatably supported in end angles or retaining brackets seen at 61 in FIG. 1.

Latch member 31 includes oppositely extending tabs or arms 32, 33 secured to a coupling shaft or sleeve 36. The function of the forward arm 32 is to lock its associated stanchion in place (hence, the term "locking arm"), and the function of the rear arm 33 is to limit the rotation of the latch member by engaging a limit pin 62 fixed to the mounting bracket 26, as seen in FIGS. 3 and 6.

Referring now to FIG. 7, each latch member 31 includes an aperture 34 which receives drive rod 30. In a preferred embodiment, drive rod 30 is hexagonal in cross-section. Thus, in FIG. 7 latch member 31 is provided with an hexagonally-shaped aperture 34 therein to accommodate the drive rod.

Each drive rod 30 is rotatably mounted to each mounting bracket 26 and the end angle brackets 61 along a respective row. Each coupling shaft 36 is positioned along the drive rod 30 immediately adjacent and to the rear of associated stanchion 22. As earlier described with reference to FIG. 1, fixedly coupled to drive rod 30 preferably at each end is an actuating arm 40 biased by means of coil springs (see reference numeral 60 in FIG. 1) in a clockwise or locking direction as viewed from the right in FIGS. 3 and 6, until the arm 33 engages the limit pin 62. Thus, with the telescoping seating extended, actuating arm 40 will assume a generally vertical orientation and locking arm 32 will securely engage a lower portion of stanchion 22 precluding the counterclockwise rotation thereof around pivot pin 25 and locking the seating in the use position. Clockwise rotation is prevented by locking nut 44 and adjusting screw 42. The length of the lower portion of stanchion 22 is such as to permit the free rotation thereof about pivot pin 25 without contacting the coupling shaft portion 36 of the release mechanism 31 when rotated to the unlocked position.

Figure 3:
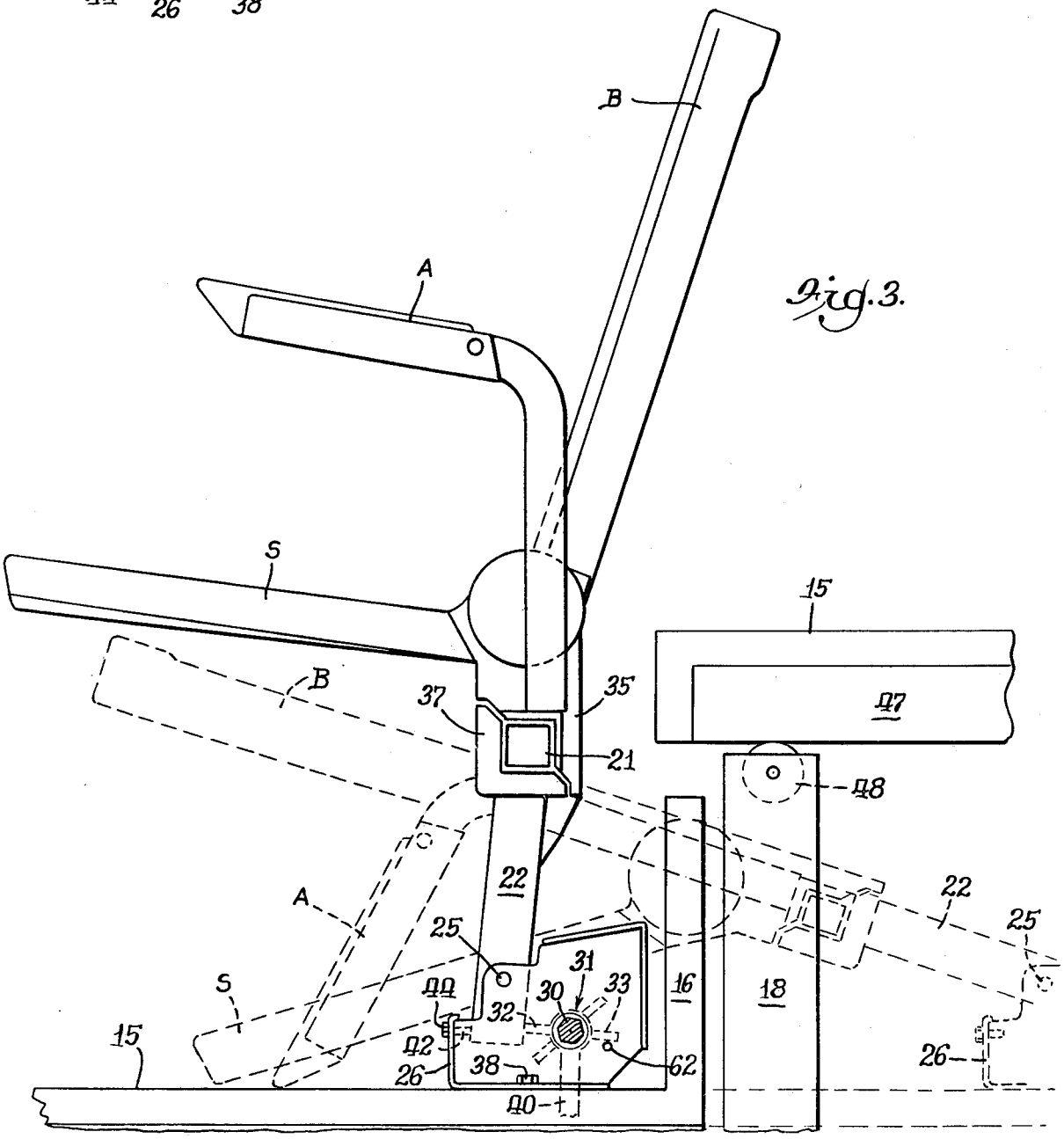
FIG. 3 is a fragmentary right side view of an individual chair installation of the system depicted in FIG. 2 showing in greater detail chair orientation and mounting in the fully extended and semi-retracted positions.

Referring now to FIG. 3, when the latch member 31 is in the locked position, the angle formed by the rear surface of stanchion 22 and the upper surface of locking arm 32 is greater than 90 to insure that forces exerted during use tend to rotate the latch member further clockwise (against limit pin 62) rather than counterclockwise which would tend to unlatch the seating. This further insures a positive locking of the seating.

It will be observed that the drive or actuating rod 30 is located toward the rear of the deck and above the platform or footrest of the deck. This facilitates assembly and access, and it obviates interference with structure below the deck. A pair of biasing springs 60 couple the actuating arms 40 to the end brackets 61 for biasing the drive rod in a counterclockwise direction as viewed from the left side to effect a positive locking of the seating in the use position, as will be clear.

Each actuating arm 40 includes a roller 41 mounted to its distal end. The counterclockwise rotation of the drive rod 30 causes the seating frame 20 to be positively locked in the use position as will be described presently. Similarly, the clockwise rotation of the drive rod 30 unlocks the seating frame 20 which is then free to pivot forwardly downward allowing the seating system to be retracted. The clockwise rotation of the drive rod 30, and hence the unlocking of the seat frame 20, is accomplished by the rearward movement of row 10 so that its rear portion engages the roller 41 of depending actuating arm 40. This causes drive rod 30 to be rotated in a clockwise direction in unlocking seat frame 20 which may then be freely rotated by contact with the nose portion 17 or row 12 upon the rearward displacement of row 11.

Referring to FIG. 2, there is shown a fragmentary side view of the present invention wherein a linear arrangement of automatically folding seats is securely mounted to the rear portion of each of rows 10, 11 and 12. Each of rows 10, 11 and 12 includes a deck portion 15 having a forward section referred to as the "nose" portion 17 thereof. A rear riser 16 may be a metal beam mounted between two upright posts, one of which is shown at 18 in FIG. 2. Support arms (not shown) extend outwardly from the posts 18 and from the riser beam to support the deck 15. The posts are mounted on a carriage structure 13 including a plurality of floor rollers 14 which provide for the translational displacement of the individual row sections along the floor 43. The lowest row 10 need not have its deck cantilevered and, as will be explained, the seating on the lowermost row may be latched and unlatched electrically. The wheel carriages for the upper rows are spread increasingly further apart so that the wheel carriages of lower rows nest between them in side-by-side relation when the rows are closed.

As shown in FIG. 2, individual chairs each having a back B, a seat S, and an arm rest A are mounted to a common horizontal beam 21 of seating frame 20. The present invention is not concerned with the manner in which the backs, seats and arm rests are mounted to the beam 21. Rather, the invention is directed to the system which automatically raises and locks, and then unlocks and lowers groups of seats as shown in FIG. 2 as the seating is converted between storage and use, and use and storage positions.

The mounting beam 21 is supported by a number of stanchions 22 each of which are pivotally mounted at a lower end by means of a mounting bracket 26 to the deck portion 15 of each row. Thus, the mounting beam 21 and stanchions 22 are rotated as a unitary structure to the upright position when a row is extended relative to the next higher row as shown in FIG. 2. Since the sequence for closing is the reverse of that for opening, when a lower row is retracted beneath the next higher row, the beam 21 and stanchions 22 are rotated forwardly so that the stanchions, beam, backs and seats can be stored in the space between the decks of adjacent rows. This is illustrated in FIG. 2 by the position of the chair in row 10 and is described in further detail below.

The rotational movement of a foldable seat between the upright, locked position and the folded, stored position will now be explained with reference to FIGS. 3 and 6. A foldable chair is securely positioned on a mounting beam 21. The mounting beam 21 is rigidly coupled to the upper end portion of stanchions 22, the lower end portions of which are pivotally coupled to mounting brackets 26 by means of pins 25. Mounting bracket 26 is securely affixed to deck 15 in a conventional manner such as by bolts 38. Each mounting bracket may also be mounted to or braced against the riser portion 16 of a row, although this is not shown in the figures. Each deck 15 is positioned above and mounted to cantilever arms, one of which is shown and designated 47. Rollers 48 rotationally positioned on the upper portion of post 18 and in contact with a lower surface of an immediately adjacent cantilever arm 47 provide for the linear relative movement of immediately adjacent rows for configuring the telescoping row seating system in either the stepped or tiered configuration when extended or the vertically aligned row configuration when retracted.

When the lower row in FIGS. 3 and 6 is moved toward the closed position, or to the right in these figures, the riser portion 16 thereof engages roller 41 and displaces the distal portion of actuating arm 40 to the right. This causes the counterclockwise rotation of drive rod 30 and latch member 31. This, in turn, results in the rotation of locking arm 32 from engagement with the lower portion of stanchion 22. Stanchion 22 is then free to rotate in a counterclockwise direction about pivot pin 25 as the row continues to retract and the seating frame engages the nose of the next higher row and is rotated to a generally horizontal position between immediately adjacent rows since the next higher row is still locked. That is, each group of chairs is rotated forwardly downward upon impact of the rear of the chairs with the nose portion 17 of the next row immediately to the rear thereof upon the rearward displacement of the row upon which the seats are positioned. Each row of seats thus pivots about an axis defined by the aligned pins 25 and is automatically folded and positioned between the deck portions of adjacent rows while the weight of the seating is at least partially offset by the torsion rods 46, as will be clear.

Figure 4:
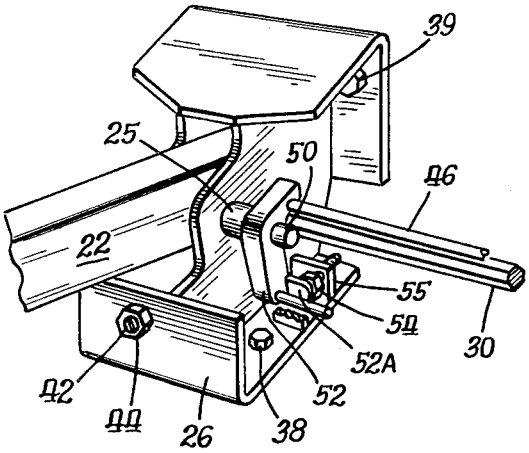
FIG. 4 is an upper right frontal perspective view of the lower portion of a chair stanchion and mounting bracket together with portions of the chair position biasing and latching mechanism.

Referring now to FIG. 4, there is shown the lower portion of a stanchion 22 pivotally coupled to mounting bracket 26 and associated chair positioning elements coupled thereto. Positioned in a forward portion of mounting bracket 26 is a set screw 42 and a locking nut 44 combination. Set screw 42 is tightened to engage the lower portion of stanchion 22 when oriented in the desired use position in order to take any "play" out of the structure in the raised, locked position that may be caused, for example, by manufacturing tolerances in the pivotal connections at pin 25. Such tolerances are desirable in this type of structure in the opening and closing movements of the rows, particularly in the higher rows which are not as rigid as the lower rows. The weight of the chairs, frame and occupants take out the vertical play. Thus, the adjustable set screw 42 is operative only in the locked or open position of each stanchion to reduce horizontal play that would otherwise be present, and which is even desirable during opening and closing movements. Once set screw 42 is properly set, locking nut 44 is tightened in order to maintain set screw 42 in the proper position.

A torque rod casting support pin 50 is included on the end of pivot pin 25 as an extension thereof. Fixedly coupled to support pin 50 is torsion rod casting 52 which is generally L-shaped. The upper end portion of torsion rod casting 52 receives one end of a torsion rod 46. The other end of torsion rod 46 is securely coupled to the rightward, immediately adjacent stanchion as shown in FIG. 1. The torsion rod 46 is used to store energy to raise the stanchion 22 to the generally upright position when the telescoping seating system is extended. It may be desirable to include bales mounted on the nose of the next higher row and aligned to engage hooks on the stanchions (as disclosed in the Hartman patent identified above but not seen in the drawing here for clarity) to asist in raising the seating. To the other lower end portion of the torsion rod casting 52 is mounted a shoulder 52A. Immediately adjacent thereto is an adjusting bolt mount 55 through which is threadably inserted a torsion adjusting bolt 54, the head portion of which engages the torsion rod casting shoulder 52A. By selctively adjusting bolt 54 in adjusting bolt mount 55, the angular position of the torsion rod casting 52 about the axis of support pin 50 may be selectively adjusted. Rotation of the torsion rod casting 52 causes a corresponding twisting displacement in the end of torsion rod 46 coupled thereto and thus preloads it. Thus, turning bolt 54 permits adjustment of the preload in the torsion rod 46 in the storage position.

Figure 5:
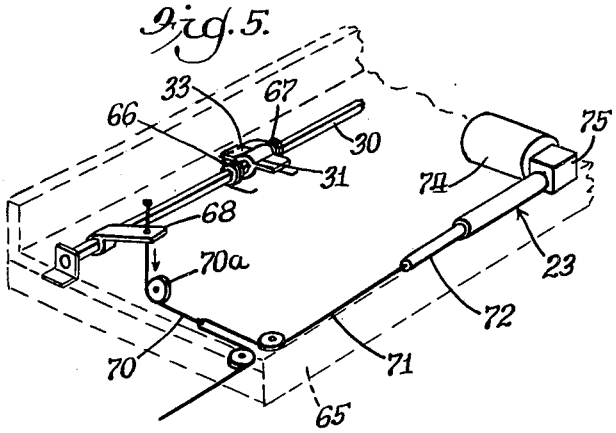
FIG. 5 is a diagrammatic view of apparatus including an electrical power actuator for unlocking the seating of the lowermost row.

The seating on the lowermost row is not actuated by the structure just described. This may be accomplished mechanically by a "dummy" row similar to the others but not extending beyond the front of the lowest row, or electromechanically by the apparatus shown in FIG. 5. Referring then to FIG. 5, the outline of the deck of the lowermost row is diagrammatically illustrated by dashed line 65. A drive rod 30 is rotatably journaled in brackets (which along with the other details are not shown for clarity) for mounting the seating. A latch member 31 has its rear arm 33 receiving the ends of first and second coil springs 66, 67 which urge the latch member 31 and rod 30 to the locking position as before.

A separate tab 68 extends outwardly of the rod 30 and is apertured to receive the end of a line 70. The line 70, in turn, extends about an idler pully 70 and is connected to a second main line 71 which, in turn, is connected to a rod 72 of a linear actuator 73. A reversible electrical motor 74 has its output coupled to a worm gear 75 which drives the actuator 73.

When the motor 74 is energized to rotate in one direction, the rod 72 is retracted, drawing the line 71 tight and pulling tab 68 down, thereby causing the rod 30 to rotate clockwise against the action of springs 66, 67 to the unlocked position for commencing a retraction cycle for the lowermost row. When the motor is reversed (after the system is extended), the rod 72 extends and springs 66, 67 rotate rod 30 and latch member 31 to the locking position. The structure of the seating not seen in FIG. 5 may be similar to that described above.

It can now be appreciated that during retraction of the rows, the seating on a given row remains locked until the next lower row is substantially fully nested beneath that row. Yet, there is some tolerance between the unlatching action and the time that the row bearing the unlatched seating is itself moved rearward.

By way of example, for a typical row depth of 22", the next lower row may move 16" before its rear engages the actuator arm 40 of the next higher row. During the next three inches of movement of the lower row, the latching mechanism for that row is actuated to the unlatched position (by moving actuator arm 40 to the rear). There are thus left an additional three inches of rearward motion of the lower row before the row whose seating was just unlocked begins its own rearward motion.

It will also be appreciated that the commencement of a retraction cycle, the lowermost row is unlatched first (by way of the apparatus illustrated in FIG. 5 in this embodiment) and that no other rows are unlatched until the first row is almost fully nested beneath the second row. Even then, only the second row, and no higher row is unlatched. Thus, the apparatus of this invention acts as a system of row locks and forces retraction of the rows in the desired sequence and reduces the "out of parallel" movement of rows.

There has thus been described a telescoping seating system having a plurality of rows wherein the seats are locked in an upright position following seating system extension with the seats in each row unlocked uniformly and simultaneously by the rearward movement of the next lower platform during seating system retraction. The uniform and simultaneous unlocking of all chairs in a given row when any one actuator arm is operated permits the system to tolerate out of parallel motion of a row.

While particular embodiments of the present invention have been shown and described, it will be apparent to those skilled in the art that changes and modifications may be made therein without departing from the invention and its broader aspects. For example, the present invention may be used with many different types of row structures and is not limited to the seating structures described herein, as persons skilled in the art will appreciate. The appended claims, therefore, are intended to cover all such changes and modifications as fall within the true spirit and scope of the invention.

I claim:

1. In a telescoping seating system having a plurality of rows adapted for movement between a use position in which said rows are in stepped relation and a storage position in which said rows are generally vertically aligned with a lower row nested beneath an upper row, each row including a deck and seating means including a frame pivotally mounted to said deck for movement between a raised use position and a lowered storage position, said frame carrying a seat for at least one occupant, the improvement comprising: drive rod means mounted for rotation to said deck; at least one actuation means connected to said drive rod means and adapted to be engaged by the next lower row when said next lower row is being retracted to rotate said drive rod means in a first direction; and latch means actuated by the rotation of said drive rod means in said first direction in response to the retraction motion of said next lower row for unlocking said frame and permitting said seating means to be stored substantially entirely between the decks of adjacent rows and actuated responsive to rotation of said drive rod means in a second direction for engaging said frame and locking same in a raised position.

2. The apparatus of claim 1 further comprising spring means for urging said drive rod means to rotate in said second direction to thereby achieve a positive locking of said seating means when said seating means is raised.

3. The apparatus of claim 1 wherein said drive rod means is located adjacent the rear of its associated deck such that during retraction a lower row is retracted substantially fully beneath the next higher row before said lower row's closing motion actuates the drive rod means on the next higher row to the release position and that there is at least some distance between said lower row's actuation of said drive rod means and said lower row's being fully nested beneath the next higher row whereby said apparatus is characterized in that during a retraction cycle, all of the seating on a given row is released before that row begins its retraction motion.

4. The apparatus of claim 3 wherein said frame of said seating means extends upwardly in the raised, locked position immediately in front of the nose of the deck of the next higher row and thereby prevents retraction of the row on which said seating means is carried until its associated latch means is actuated to the release position thereby providing a row lock structure and forcing retraction of said rows in predetermined sequence by retracting the lowest extended row first.

5. The apparatus of claim 1 wherein said frame of said seating means includes a horizontal member, a plurality of laterally spaced stanchions attached at one end to said horizontal member and pivotally mounted at their other ends for rotation about a common horizontal axis, and a plurality of seats carried side-by-side on said horizontal member; said drive means comprises a rod extending substantially at least the length of said horizontal member; and said actuation means comprises first and second actuator arms fixed at widely laterally spaced locations on said rod, whereby when the next lower row engages and moves either one of said actuator arms, said rod is rotated to unlatch said seating means.

6. The apparatus of claim 5 further comprising spring means for urging said drive rod means to the latching position and wherein said latch means comprises an arm for each stanchion, said arms extending radially of said drive rod means and adapted when said drive rod means is rotated to the latch position to engage the back of an associated stanchion at a location below the horizontal pivot axis thereof to prevent rotation of said frame to the storage position.

7. The apparatus of claim 6 further comprising first limit means for limiting the rotation of said seating frame to the use position and cooperating with said arms of said drive rod to lock an associated stanchion in the raised position.

8. The apparatus of claim 7 further comprising means for adjusting said first limit means.

9. The apparatus of claim 6 further comprising second limit means for limiting the rotation of said drive rod means in the locking position such that an obtuse angle is formed by the axes of a stanchion and its associated arm on said drive rod means to prevent dislodging thereof in the locking position.

10. The apparatus of claim 2 further comprising means for biasing said frame in said raised use position said frame being lowered to the storage position against the action of said biasing means by engagement of said seating means by a next higher row upon the rearward displacement of the row on which said frame is carried.

11. The apparatus of claim 10 wherein the engagement of said seating means with said next higher row upon the rearward motion of the row on which said frame is carried causes the forwardly downward rotational movement of said seating means and frame to a generally horizontal position for storage substantially entirely between the decks of adjacent rows.

12. The apparatus of claim 10 wherein said biasing means comprises torsion rod means for at least partially offsetting the weight of said seating means during lowering of the same.

13. The apparatus of claim 12 wherein said frame is pivotally mounted to said deck by means of a rotational bracket, said rotational bracket including bias control means for selectively establishing the upwardly urging torque applied to said frame.

14. The system of claim 1 wherein said latch means includes a locking arm fixedly positioned on said drive rod means immediately adjacent a lower portion of said frame for engaging the lower portion of said frame and locking said frame in a raised position when said drive rod means is rotated in said second direction and wherein said locking arm is displaced from engaging contact with the lower portion of said frame when said drive rod means is rotated in said first direction in unlocking said frame for permitting said seating means to be stored substantially entirely between the decks of adjacent rows.

15. The system of claim 14 wherein said frame includes at least one stanchion and a mounting beam coupled to an upper portion of said stanchion and upon which is mounted at least one seat and wherein said stanchion is pivotally coupled at a lower portion thereof to said deck with the lower portion of said stanchion engaged by said locking arm to inhibit the displacement thereof when said seating system is extended.

16. The system of claim 14 wherein said actuation means includes at least one actuator arm mounted to said drive rod means so as to cause the rotation thereof in said first direction when a distal portion of said actuator arm is engaged and displaced by the next lower row when said next lower row is nearly fully retracted.

17. The system of claim 15 comprising first and second actuator elements are mounted to said drive rod means in laterally spaced relation.

18. The apparatus of claim 17 wherein each of said actuator elements includes a roller rotationally coupled to a distal portion thereof for engaging the next lower row when said next lower row is nearly fully retracted in facilitating the unlocking of said frame.

19. The apparatus of claim 18 wherein the cross-section of said drive rod means is hexagonal.

20. The apparatus of claim 1 further comprising biasing means for urging said drive rod means in said second direction of rotation by biasing means for ensuring the locking of said frame when said seating means is raised to the use position.

21. The apparatus of claim 20 wherein said biasing means includes at least one spring associated with said drive rod means for urging said drive rod means in said second direction of rotation.

22. The apparatus of claim 20 further including adjustable limit means for selectively setting the raised use position of said frame.

23. In telescoping seating apparatus having a plurality of rows adapted for movement between a use position in which said rows are in stepped relation and a storage position in which said rows are generally vertically aligned with a lower row nested beneath an upper row, each row including a deck and seating means including a frame pivotally mounted to said deck for movement between a riased use position and a lowered storage position, said frame extending laterally along said deck and carrying a plurality of seats, the improvement comprising:

elongated drive means extending along a row and mounted for rotation on said row; latch means actuated by rotation of said drive means in a first direction for locking said frame in a raised position and actuated by rotation of said drive means in a direction counter to said first direction for unlocking said frame; a plurality of actuator means spaced along said drive means, each located to be engaged by the retraction of the next lower row for rotating said drive means in said counter direction whereby the actuation of any one of said actuator means actuates said drive means; and characterized in that the seating means on any row is unlocked and prepared for lowering to said storage position before the retraction of that row is initiated.

* * * * *